US005853931A

United States Patent [19]

Yamamoto

[11] Patent Number: 5,853,931

[45] Date of Patent: Dec. 29, 1998

[54] PHOTORECEPTOR FOR ELECTROPHOTOGRAPHY

[75] Inventor: Shinya Yamamoto, Niigata, Japan

[73] Assignee: NEC Corporation, Tokyo, Japan

[21] Appl. No.: 861,660

[22] Filed: May 22, 1997

[30] Foreign Application Priority Data

May 22, 1996 [JP] Japan ..... 8-126934

[51] Int. Cl.[6] ..... G03G 5/147

[52] U.S. Cl. ..... 430/58; 430/66

[58] Field of Search ..... 430/58, 59, 66, 430/96

[56] References Cited

U.S. PATENT DOCUMENTS 5,157,018 10/1992 Muller ..... 430/96
5,561,016 10/1996 Suzuki et al. ..... 430/96

FOREIGN PATENT DOCUMENTS 57-212624 12/1982 Japan .
61-184562 8/1986 Japan .
4-353860 12/1992 Japan .

OTHER PUBLICATIONS

T. Sato et al., "Mechanical Properties of Overcoating Layer for . . . to Film Lifetime and Tonerfilming", Info. and Comm. Research Center, Matsushita Electric Ind. Co., Ltd., pp. 91–94 with English Abstract.

T. Sato et al., "Development of Overcoating Layer for Multiple–Layered Positive . . . Photoconductor", Info. and Comm. Research Center, Matsushita Electric Ind. Co., Ltd., pp. 185–188 with English Abstract.

*Primary Examiner*—John Goodrow
*Attorney, Agent, or Firm*—Sughrue, Mion, Zinn, Macpeak & Seas, PLLC

[57] ABSTRACT

A photoreceptor for electrophotography has a substrate, charge-generation layer and a charge-transport layer, with either one of the charge-generation layer and charge-transport layer being a top OPC layer formed from a paint. The top OPC layer contains a surfactant having a perfluoroalkyl radical in an amount between 0.01% and 1% by weight of a solid ingredient of the paint. The surfactant functions for prevention of reduction in film thickness and occurring of flaws on the top OPC layer caused by abrasion after iterative operation of the photoreceptor.

11 Claims, 1 Drawing Sheet

PHOTORECEPTOR FOR ELECTROPHOTOGRAPHY

BACKGROUND OF THE INVENTION (a) Field of the Invention

The present invention relates to a photoreceptor for electrophotography for use in an imaging device using an electrophotographic technique, such as a copying machine, printer and facsimile.

(b) Description of the Related Art

An imaging device using an electrophotographic technique, such as a copying machine, printer and facsimile, forms an electrostatic latent image on a photoreceptor having a photoconductive property. The process for forming a latent image includes consecutively the steps of electrifying the surface of the photoreceptor by a corona discharge etc., exposing the surface of the photoreceptor to form a latent image, and developing the surface with toner to form a visual image.

The photoreceptor for electrophotography for use in the process as mentioned above is required to have a sufficient electrifying ability in the shade and also a sufficient dissipating ability for promptly dissipating the generated charge by an optical irradiation. In addition, the photoreceptor is also required to have a durability to electrical or mechanical external force for assuring iterative operation of electrifying, toner development, transcription and cleaning.

Generally, a conventional photoreceptor for electrophotography contains an inorganic photoconductive compound as a principal ingredient thereof such as selenium (Se), cadmium sulfide (CdS) and zinc oxide (ZnO). However, these inorganic photoconductive materials suffer from a low through put in the manufacturing process or have a problem of toxicity. To overcome theses problems, photoreceptors having an organic photoconductive (OPC) material, hereinafter referred to as OPC photoreceptors, are actively developed and some are used as practical products.

The OPC material can be manufactured to have a sensitivity to a light of a near infrared ray wavelength by selecting a molecular structure or a crystal type thereof, which is generally difficult in an inorganic photoconductive compound. The photoreceptor containing an OPC is especially important as such for use in an electrophotographic process, wherein a semiconductor laser having a near infrared ray wavelength in oscillation is used for printing in a digital format.

Such a conventional OPC photoreceptor is widely used as a laminate photoreceptor of a separate function type, wherein a paint including a charge-generation material is applied onto the surface of an aluminum or aluminum alloy substrate to form thereon a charge-generation layer, onto which another paint including a charge-transport material is applied to form a charge-transport layer.

In general, a paint to be used to form the charge-generation layer or charge-transport layer for an OPC photoreceptor is obtained by dispersing or dissolving an OPC charge-generation material or charge-transport material in a binder resin. The charge-generation layer or charge-transport layer thus manufactured from the paint suffers from a low mechanical strength compared to a photoreceptor made of an inorganic photoconductive compound. Accordingly, iterative use of a photoreceptor including a top OPC layer constituting a charge-generation layer or charge-transport layer in an electrophotographic process damages the top OPC layer by abrasion to make the top layer thinner and thinner or to make flaws on the top OPC layer, thereby degrading the image quality generated therefrom.

The mechanical strength of the OPC photoreceptor is most reflected by the characteristics of the binder resin in the top layer. Accordingly, active researches have been conducted to improve the mechanical strength of the binder resin substantially without degrading the basic electric characteristics thereof as a photoreceptor.

In most conventional OPC photoreceptors, the top OPC layer is implemented as a charge-transport layer, and polycarbonate is used for the binder resin of the charge-transport layer from the viewpoint of a charge-transfer function and a mechanical strength. The charge-transport layer containing therein polycarbonate is, however, also inferior in mechanical strength to a conventional photoreceptor made of an inorganic material.

A protective layer is sometimes formed on the charge-transport layer to improve the mechanical strength of the OPC photoreceptor. The protective layer is practically obtained from a material wherein a specific substance for improving the electric resistance and controlling the surface frictional coefficient is dispersed into a hardening resin. The photoreceptor is also obtained by evaporation of an inorganic material. Although the protective layer, if used, remarkably improves the mechanical strength of the OPC photoreceptor, the protective layer raises fabrication costs for the photoreceptor. Accordingly, the use of the protective layer is generally limited to only a high-grade product.

SUMMARY OF THE INVENTION

It is an object of the present invention, to solve the problems as described above in the conventional photoreceptor for electrophotography, and to provide an improved photoreceptor for electrophotography wherein the mechanical strength is improved without providing a protective layer, to suppress degradation of the image quality caused by abrasion of the OPC layer at a relatively low cost.

The present invention provides a photoreceptor for electrophotography comprising a substrate and at least one photoconductive (OPC) layer formed on the substrate and having a charge-generation function and a charge-transport function, the at least one OPC layer including a top layer containing a surfactant having a perfluoroalkyl radical.

In accordance with the present invention, the surfactant having a perfluoroalkyl radical reduces frictional coefficient of the top layer for prevention of reduction in thickness and occurring of flaws in the top layer caused by abrasion, thereby maintaining an excellent image quality after iterative operation of the photoreceptor.

The above and other objects, features and advantages of the present invention will be more apparent from the following description, referring to the accompanying drawing.

PREFERRED EMBODIMENTS OF THE INVENTION

Now, the present invention will be more specifically described based on preferred embodiments thereof with reference to the drawings.

Figure 1:
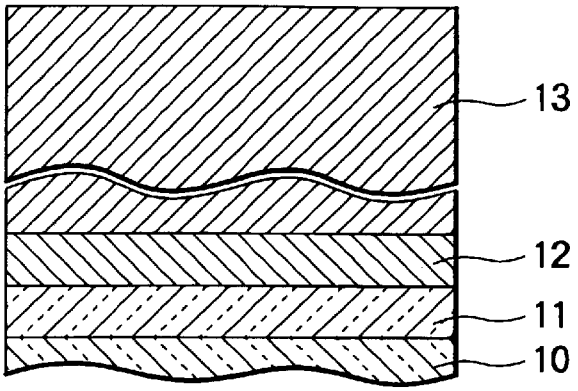
FIG. 1 is a sectional view of a photoreceptor for electrophotography according to an embodiment of the present invention.

Referring to FIG. 1, the OPC photoreceptor according to an embodiment of the present invention comprises an aluminum substrate 10, and an intermediate layer 11, a charge-generation layer 12 and a charge-transport layer 13 consecutively formed on the surface of the aluminum substrate 10. In this example, the charge-transport layer 13 is formed as the top layer. The OPC photoreceptor is, for example, of a cylinder shape having a diameter of 30 mm and a length of 335 mm.

A paint to be used for forming the top charge-transport layer 13 contains a surfactant which has a perfluoroalkyl radical and added therein to improve the dispersion ability of the charge-transport agent into the binder resin and to decrease the ruggedness and frictional resistance on the surface of the resultant layer. In this configuration, resistance against abrasion (or abrasion resistance) in the charge-transport layer 13 is remarkably improved to thereby decrease the occurrence of the flaws and reduction in the thickness of the layer.

The paint for the top charge-transport layer is obtained by dissolving or dispersing a charge-transport agent into a solvent wherein a binder resin is dissolved, and in addition, an antioxidant (or inhibitor) and an absorbent for ultra-violet ray are added, if necessary. Examples for the charge-transport material include poly-N-vinylcarbazole and derivatives thereof, pyres-formaldehyde condensate and derivatives thereof, polysilane and derivatives thereof, oxazole derivatives, oxadiazole derivatives, monoarylamine derivatives, diaryl amine derivatives, triarylamine derivatives, stilbene, derivatives, benzidine derivatives, pyrazoline derivatives, hydrazone derivatives, and butadiene derivatives, which can be used alone or as a combination of two or more of them. Examples for the binder resin include polyvinyl-chloride (PVC), polyvinyl acetate, polyvinyl butyral, polyester, polyurethane, polycarbonate, acrylic resin, and phenol resin, etc., which can be used alone or as a combination of two or more of them. Examples for the solvent include toluene, the xylene, monochlorobenzene, methyl alcohol, ethyl alcohol, ethyl acetate, methylene chloride, tetrahydrofuran, cyclohexane etc., which can be used alone or as a combination of two or more of them.

The charge-transport layer can be formed by well known coating techniques such as spin-coating, application, spray-coating, bar-coating, dip-coating, doctor-blading etc. Thickness of the top charge-transport layer 13 resides preferably between 5 mm and 40 mm, and more preferably between 15 mm and 25 mm.

The surfactant having a perfluoroalkyl radical should be added to the paint for the charge-transport layer in an amount from 0.01% to 1% by weight of a solid ingredient in the paint. The addition of the surfactant reduces the surface tension of the paint to thereby reduce the ruggedness on the layer surface and improves the dispersion ability of the charge-transport agent into the binder resin to thereby increase the mechanical strength of the layer. In addition, the perfluoroalkyl radical in the surfactant allows the surfactant to exude from the charge-transport layer to the surface thereof during drying to thereby reduce the frictional resistance of the paint after the drying. These effects as combined improve the abrasion resistance of the charge-transport layer 13 and suppress occurring of the flaws on the surface of the top charge-transport layer.

Some OPC photoreceptors have a top layer constituting a charge-generation layer. In accordance with the present invention, the paint for the top charge-generation layer contains a surfactant having a perfluoroalkyl radical. The paint used to form the top charge-generation layer in this case should be composed of a binder resin and a charge-generation agent, or, in addition to them an antioxidant or absorbent for ultraviolet rays, if necessary. Examples for the charge-generation layer include known materials such as phthalocyanine pigments, naphthalocyanine pigments, azo pigments, indigo pigments, perylene pigments, perynon pigments, quinacridone, squarylium salt, which can be used alone or as a combination of two or more of them. Examples for the binder resin include PVC, polyvinyl acetate, polyvinyl butyral, polyvinylformal, polyester, polyurethane, polycarbonate, acrylic resin, phenol resin, etc., which can used alone or as a combination of two or more of them. Examples for the solvent include toluene, xylene, monochlorobenzene, methyl alcohol, ethyl alcohol, ethyl acetate, methylene chloride, tetrahydrofuran, cyclohexane etc., which can be used alone or as a combination of two or more of them.

The charge-generation layer can be formed by well known coating technique such as spin-coating, application technique, spray-coating, bar-coating, dip-coating, doctor-blading. The thickness of the charge-generation layer resides preferably between 0.05 mm and 5 mm, and more preferably between 0.1 mm and 2 mm.

Figure 2:
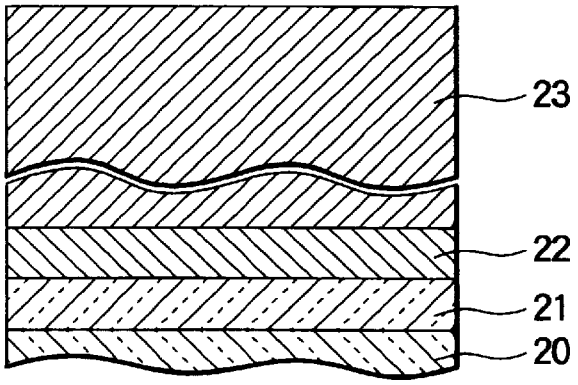
FIG. 2 is a sectional view of a photoreceptor for electrophotography according to another embodiment of the present invention.

The surfactant which has a perfluoroalkyl radical should be added to the charge-generation layer in an amount between 0.01% and 1% by weight of the solid ingredient in the paint for the charge-generation layer. The surfactant added in the charge-generation layer has a function similar to the surfactant having a perfluoroalkyl radical added in the charge-transport layer. FIG. 2 shows the structure of a photoreceptor of this type according to the present invention, which comprises an aluminum substrate 20, and an intermediate layer 21, a charge-transport layer 22 and a charge-generation layer 23 consecutively formed on the aluminum substrate 20.

Figure 3:
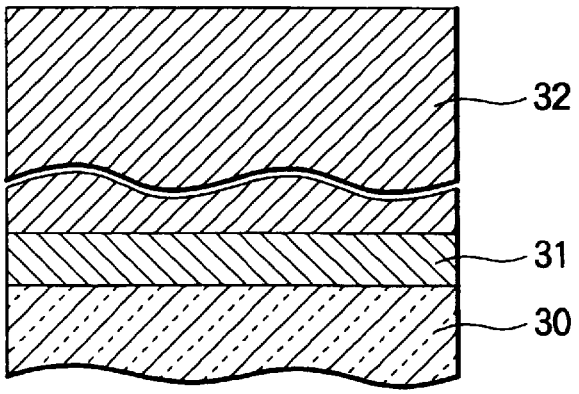
FIG. 3 is a sectional view of a photoreceptor for electrophotography according to another embodiment of the present invention.

Some OPC photoreceptors are implemented as single layer OPC photoreceptors by using a single paint wherein a charge-transport agent and a charge-generating agent are dispersed into a binder resin, or a single agent having both charge-transport and charge-generation functions is dispersed into a binder resin. In this case, a surfactant having a perfluoroalkyl radical is added in the paint for the single OPC layer according to the present invention. FIG. 3 shows a photoreceptor of this type, which includes an aluminum substrate 30, and an intermediate layer 31 and a top OPC layer 32 consecutively formed on the substrate 30.

To confirm the advantages of the OPC photoreceptor according to the present invention, comparative tests for the layer characteristics were performed to four different samples according to the embodiment of FIG. 1 and another sample manufactured as a comparative example. Printing quality, reduction in the film thickness, occurring of flaws and residual potential were measured for each of the samples. The measurements were effected for each sample after 5,000-page printing therefrom on a laser printer.

Embodiment 1

OPC photoreceptor of the first embodiment was manufactured as follows:

A paint for a charge-generation layer is prepared by 2 wt. % oxotitanium phthalocyanine (TiOPc) and 2 wt. % polyvinyl butyral are dispersed together with tetrahydrofuran in a ball mill for 24 hours. Another paint for a charge-transport layer is prepared by 20 wt. % charge-transport agent known as 1.1-bis(p-diethyl-aminophenol)-4.4-diphenyl-1.3-butadiene and 20 wt. % polycarbonate are dissolved into 60 wt. % methylene chloride, followed by addition of Unidyne DS-401 (in trade mark, from Daikin Corp.) known as a surfactant having a perfluoroalkyl radical in an amount of 0.05% by weight of solid ingredient in the paint. The charge-transport agent as used herein is resented by the following formula:

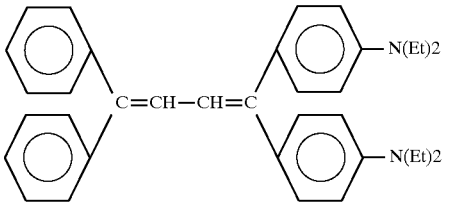

A 7-mm thick intermediate layer 11 was formed by oxidizing the surface of an aluminum substrate by a plate oxidation technique, followed by formation of a 0.2-mm thick charge-generation layer 12 on the intermediate layer 11, and followed by formation of a 20-mm thick charge-transport layer 13 to thereby obtain a photoreceptor of the first Embodiment.

Embodiment 2

The second Embodiment was manufactured similarly to the first Embodiment except for the amount of addition of Unidyne DS-401 which was 0.1 wt. % of the solid ingredient in the paint.

Embodiment 3

The third Embodiment was manufactured similarly to the first Embodiment except for the surfactant having a perfluoroalkyl radical which was selected as Fluorad FC-171 (in trade mark, from Sumitomo 3M corp.)

Embodiment 4

The fourth Embodiment was manufactured similarly to the first Embodiment except for a material of the charge-transport layer which was selected as 2-methyl-4-dibenzilamine-benzaldehyde-N.N-diphenylhydrazone having the following formula:

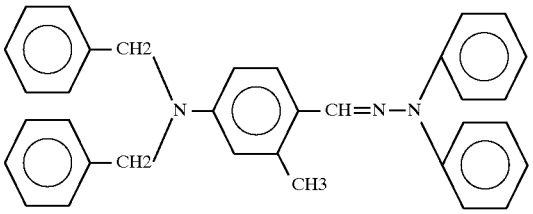

Comparative Example

The Comparative Example was manufactured similarly to the first embodiment except that the surfactant having a perfluoroalkyl radical was not added to the photoreceptor.

Table 1 shows the results for each sample.

TABLE 1

| | Printing Quality | Reduction of thickness (mm) | Presence of Flaws | Residual Potential (volts) |
|---|---|---|---|---|
| Embodi. 1 | good | 3.6 | Some | 23 |
| Embodi. 2 | good | 3.8 | some | 30 |
| Embodi. 3 | good | 4.1 | some | 25 |
| Embodi. 4 | good | 3.5 | some | 25 |
| Comp. Ex | good | 5.2 | many | 18 |

As understood from Table 1, the photoreceptor containing, as an additive, a surfactant having a perfluoroalkyl radical exhibits a low reduction in film thickness and small number of flaws, which shows an improvement of resistance of the top OPC layer against abrasion. Although the surfactant raises the residual potential in a small amount, the small amount does not substantially affect the printing quality.

What is claimed is:

1. A photoreceptor for electrophotography comprising a substrate and at least one photoconductive (OPC) layer formed on said substrate and having a charge-generation function and a charge-transport function, said at least one OPC layer including a top layer containing a surfactant in an amount between 0.01% and 1% by weight of solid ingredient in said top layer, said surfactant having a perfluoroalkyl radical, and said surfactant having been exuded to a surface of said top layer of said at least one OPC layer.

2. A photoreceptor for electrophotography as defined in claim 1 wherein said top layer is made from a paint.

3. A photoreceptor for electrophotography as defined in claim 2 wherein said paint is composed of a material having both charge-generation function and charge-transport function.

4. A photoreceptor for electrophotography as defined in claim 1 wherein said at least one OPC layer further includes a charge-generation layer between said substrate and said top layer, wherein said top layer functions as a charge-transport layer.

5. A photoreceptor for electrophotography as defined in claim 1 wherein said at least one OPC layer further includes a charge-transport layer between said substrate and said top layer, wherein said top layer functions as a charge-generation layer.

6. A photoreceptor for electrophotography as defined in claim 1 wherein said at least one OPC layer further includes an intermediate layer between said substrate and said top layer.

7. A photoreceptor for photography as defined in claim 2 wherein said surfactant reduces the surface tension of the paint.

8. A photoreceptor for photography as defined in claim 7 wherein said surfactant improves the dispersion ability of a charge transport agent into a binder resin in said top layer.

9. A photoreceptor for photography as defined in claim 7 wherein said surfactant increases mechanical strength of said top layer.

10. A photoreceptor for photography as defined in claim 2 wherein said surfactant reduces frictional resistance of said paint after drying.

11. A photoreceptor for photography as defined in claim 1 wherein said surfactant is selected from the group consisting of UNIDYNE DS-401 and Fluorad FC-171.

* * * * *